US008727148B2

(12) United States Patent
Soehnlen et al.

(10) Patent No.: US 8,727,148 B2
(45) Date of Patent: May 20, 2014

(54) FLIP CAP

(75) Inventors: Daniel P. Soehnlen, Canton, OH (US); Gregory M. Soehnlen, North Canton, OH (US)

(73) Assignee: Creative Edge Design Group, Ltd., Canton, OH (US)

( * ) Notice: Subject to any disclaimer, the term of this patent is extended or adjusted under 35 U.S.C. 154(b) by 150 days.

(21) Appl. No.: 13/119,339

(22) PCT Filed: Sep. 17, 2009

(86) PCT No.: PCT/US2009/057336

§ 371 (c)(1), (2), (4) Date: Mar. 16, 2011

(87) PCT Pub. No.: WO2010/033715

PCT Pub. Date: Mar. 25, 2010

(65) Prior Publication Data

US 2011/0168661 A1 Jul. 14, 2011

Related U.S. Application Data

(60) Provisional application No. 61/097,648, filed on Sep. 17, 2008.

(51) Int. Cl.
*B65D 47/00* (2006.01)
*B65D 47/40* (2006.01)

(52) U.S. Cl.
USPC ..... 215/200; 215/235; 215/253; 215/254; 215/341; 220/269; 222/554; 222/556; 222/476; 222/571; 222/575; 239/601

(58) Field of Classification Search
USPC ..... 222/556, 476, 481, 571, 575, 109; 215/235, 253, 254, 341; 220/269, 839; D9/440, 518; 239/601
See application file for complete search history.

(56) References Cited

U.S. PATENT DOCUMENTS 684,069 A * 10/1901 Knorr ..... 222/109
2,101,175 A * 12/1937 Gustafsson ..... 239/8

(Continued)

FOREIGN PATENT DOCUMENTS

WO WO 2008/091936 A2 7/2008

OTHER PUBLICATIONS

PCT/US2009/057336 International Search Report.

*Primary Examiner* — Mickey Yu
*Assistant Examiner* — Gideon Weinerth
(74) *Attorney, Agent, or Firm* — Fay Sharpe LLP

(57) ABSTRACT

A cap is received on an associated bottle opening. The cap preferably includes an annular body and a sidewall that includes a thread member extending around at least a portion of an inner surface thereof. A closing surface extends substantially perpendicular to the sidewall and is dimensioned to cover the associated bottle opening. As disclosed, an opening in the cap closing surface has first, second, and third portions that each form distinct interconnected narrow, intermediate, and large pour opening portions. A lid is selectively received on the closing surface and includes a seal extending outwardly from a surface thereof. The seal includes similarly dimensioned first, second, and third portions that conform to and selectively seal with the first, second, and third portions of the cap opening. Another exemplary embodiment includes a tear-away panel portion that includes a tab to aid in removal of the panel portion and forming the opening.

23 Claims, 4 Drawing Sheets

(56) References Cited

U.S. PATENT DOCUMENTS

| | | | | | |
|---|---|---|---|---|---|
| 2,898,015 | A | * | 8/1959 | Borah | 222/484 |
| 4,061,243 | A | | 12/1977 | Khoury | |
| 4,513,914 | A | * | 4/1985 | Cook | 239/121 |
| 4,735,334 | A | * | 4/1988 | Abbott | 222/546 |
| 4,770,325 | A | * | 9/1988 | Gordon et al. | 222/481 |
| 4,887,747 | A | * | 12/1989 | Ostrowsky et al. | 222/556 |
| 5,664,733 | A | * | 9/1997 | Lott | 239/429 |
| 5,868,323 | A | * | 2/1999 | Cantor | 239/589 |
| 6,257,431 | B1 | * | 7/2001 | Baudin | 215/237 |
| 6,367,670 | B1 | * | 4/2002 | Warner et al. | 222/556 |
| 6,510,971 | B1 | * | 1/2003 | Martin | 222/556 |
| 6,564,978 | B1 | * | 5/2003 | Safian et al. | 222/534 |
| 6,691,394 | B1 | * | 2/2004 | McClean | 29/434 |
| 7,225,947 | B2 | * | 6/2007 | Leuenberger et al. | 222/83 |
| D614,488 | S | * | 4/2010 | Kallenbach et al. | D9/449 |
| 7,870,980 | B2 | * | 1/2011 | Wilson et al. | 222/571 |
| 2004/0065697 | A1 | * | 4/2004 | DeGroot et al. | 222/556 |
| 2005/0205618 | A1 | * | 9/2005 | Mabee et al. | 222/541.9 |
| 2006/0016836 | A1 | * | 1/2006 | Gaiser | 222/556 |

* cited by examiner

FLIP CAP

This application is the US national entry of PCT application PCT/US2009/057336, filed Sep. 17, 2009, and claims the priority benefit of U.S. Provisional application Ser. No. 61/097,648, filed Sep. 17, 2008.

BACKGROUND

This disclosure relates to an improved cap for a fluid bottle or container, and more particularly a reclosable cap that facilitates dispensing of fluid from an opening of the container, and also includes a hinged lid that effectively seals the container.

Published International Application WO2008/091936 is a commonly owned application and generally directed to a closure cap used in the same general environment of the present disclosure, the disclosure of which is expressly incorporated herein by reference. Although commercially successful, there is a need for improved sealing capability, and a need to enhance pouring of the contents from the container. Generally, these types of caps are a molded structure in which the body includes internal thread portions that allow the cap to be threaded onto an externally threaded shoulder of the associated container, or alternatively to be snap-fit over the threaded shoulder. The shoulder surrounds the dispensing opening of the container. In some arrangements, the opening is flush or slightly below a plane generally defining a remainder of an upper surface of the container while in other instances, the opening protrudes above the upper surface.

As shown in the noted published international patent application, an enlarged diamond-shaped opening is provided in the cap with a vertex of an acute angle serving as the pour region of the cap. The oppositely disposed vertex of the diamond-shaped opening is located more closely to the hinge. A lid is joined to the body preferably by a living hinge, i.e., a thin region of plastic material that is integrally formed between the lid and the cap body. In this manner, once contents have been dispensed from the container through the cap opening, the lid is then positioned over the opening and seals contents of the container from the external environment.

This known arrangement also preferably includes a foil/polyethylene composite seal that is fusion bonded to an upper perimeter of the dispensing opening. Subsequently, the cap is received over the opening. Thus, in order for the container contents to be dispensed, a consumer must initially remove the cap, peel off the foil/polyethylene seal, and then re-install the cap onto the container. The foil/polyethylene seal assures that the container or bottle is sealed from the external environment. In other words, improved sealing is desired during shipment of the filled container from the manufacturing plant to the store.

Accordingly, a need exists for a reclosable cap assembly that eliminates the use of a foil/polyethylene composite sealed beneath the cap during shipping, that is substantially smaller in height, and effectively seals and re-seals the container, and that need not be removed from the container by the consumer prior to dispensing the contents of the container.

SUMMARY OF THE DISCLOSURE

An improved cap dimensioned for receipt on a threaded shoulder surrounding a container opening is provided.

The cap includes an annular body having an internally threaded sidewall where a thread member extends around at least a portion of the sidewall, a closing surface extending substantially perpendicular to the sidewall and dimensioned to cover the associated container opening, an opening in the closing surface having first, second, and third portions that form distinct, interconnected narrow, intermediate, and large pour opening portions. The lid is selectively received on a closing surface and includes a seal extending outwardly from a surface where the seal has first, second, and third portions that conform to the first, second, and third portions of the opening.

The opening first, second, and third portions preferably each include arcuate perimeters.

The arcuate perimeters of the openings of the first and third portions each extend over approximately 235°. A hinge connects the lid to the body.

The narrow pour opening portion is disposed opposite from the hinge. Further, the first, second, and third portions of the opening are preferably disposed in linear relation.

The closing surface includes a first tapering region that extends from a maximum diameter of a large pour opening portion to and around perimeter portions of the narrow and intermediate pour opening portions.

The first tapering region preferably extends from opposite edges of the maximum diameter of the large pour opening portion toward a pour lip region in a direction substantially perpendicular to a pivot axis of a hinge.

A second tapering region extends downwardly from an outer perimeter of the closing surface toward a center of the closing surface.

A primary benefit of the present disclosure relates to the reduced cost associated with eliminating a foil/polyethylene composite seal, and substantially reducing the size of the cap, namely reducing the height of the cap.

Yet another advantage resides in the ability to more effectively reseal the opening.

A further advantage is that a further tamper preventive feature is provided by securing the cap to the container and likewise that a consumer never has to remove the cap from the container.

Still other benefits and advantages of this disclosure will become more apparent from the following detailed description.

DETAILED DESCRIPTION OF THE PREFERRED EMBODIMENTS

Figure 4:
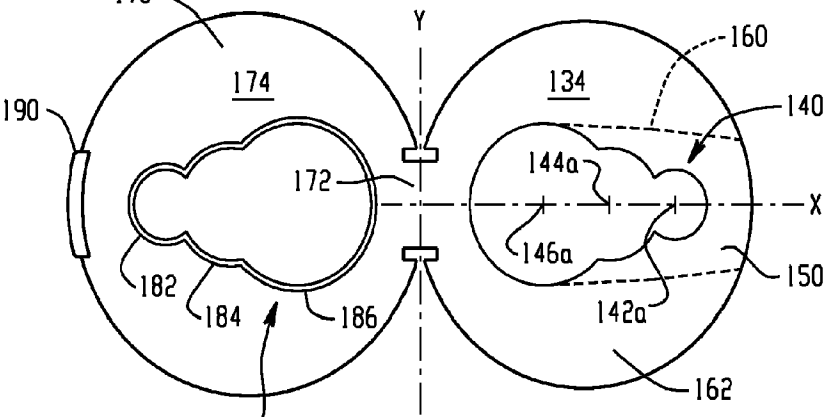
FIG. 4 is a plan view from an upper side of the cap with the lid in an open position relative to the body.
Figure 5:
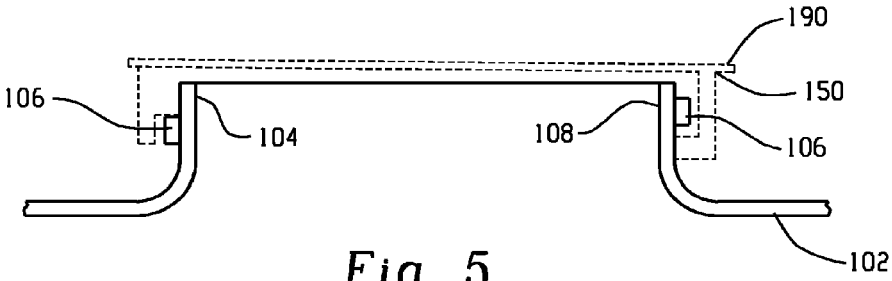
FIG. 5 is an elevational view of the associated container and illustrating receipt of a cap thereon.

Turning first to FIGS. 1-5, there is shown a cap or cap assembly 100 preferably a molded plastic cap that is dimensioned for receipt on an associated container or bottle 102 (such as a milk bottle or similar fluid container) (FIG. 5). By way of example, the cap is used on a fluid container of the type shown and described in commonly owned U.S. Pat. No. 6,068,161, although use of the cap is not limited to this container. The container typically includes a neck or shoulder 104 that is preferably externally threaded as represented by externally threaded portions/thread lugs or a continuous helical thread 106 that extends about an opening 108 in the shoulder. The contents of the container (such as milk or another fluid) may be selectively poured through this opening when the cap is opened. The container opening may also be used to fill the container with fluid through the same opening. It will be appreciated, however, that the container could be filled through a different opening (not shown) if desired without departing from the scope and intent of the present disclosure.

The cap 100 includes a generally annular body 120 having a sidewall 122 that preferably includes internal thread portions 124 (FIGS. 2-3) that cooperate with the external thread portions 106 on the container. For example, the thread portions 124 may be circumferentially spaced thread segments/thread lugs, or may be continuous helical thread(s), that cooperate with the external threads of the container. In some instances, the cap is threaded onto the shoulder of the container, while in other instances, the cap is manually pushed over the container threads when the cap is installed on the container. In still other instances, the cap need not be an annular body and instead adopt a different conformation while retaining other features of the present disclosure described herein.

The cap is substantially smaller (and thus requires substantially less material) than prior caps. More particularly, sidewall 122 of the cap body 120 has a height substantially less than that of prior art constructions. For example, a total height of the sidewall 122 on the order of approximately 0.30 to 0.45 inches is substantially less than the total height of approximately 0.58 inches in prior art cap constructions. Further, a first or upper end of the sidewall may taper slightly outward as represented by reference numeral 126 in FIG. 2. The sidewall merges into a closing surface or region 130 that includes an underside surface 132 (FIG. 3) and an upper or outwardly facing surface 134 (FIG. 4). An opening 140 extends through the closing region, i.e., extending from the first or lower surface 132 to the second or outer surface 134. The opening preferably includes distinct interconnected or contiguous first, second, and third portions 142, 144, 146, respectively. Each of the first, second, and third portions of the opening are differently sized and preferably have generally arcuate perimeter portions. More particularly, the first and third opening portions are substantially circular and preferably have generally arcuate perimeters that extend over approximately 235°. The generally arcuate perimeters are each defined about center points 142*a*, 144*a*, 146*a* of the first, second, and third portions, respectively, of the opening and the center points preferably are co-linear along an axis "X" that extends generally diametrically through the cap. Each of the first, second, and third portions of the opening are of a distinctly different size. The first portion 142 forms a narrow pour opening portion adjacent a pour lip 150 while the second portion 144 defines an intermediate pour opening portion, and the third portion 146 defines a large pour opening portion. As noted previously, each of these pour opening portions is contiguous or interconnected with an adjacent pour opening portion, however each defines a distinct pour region that provides greater control of fluid flow from the container while pouring. Preferably, the first portion 142 of the opening and likewise the narrow pour opening region is closest to the pour lip 150 of the cap.

As is more particularly evident in FIG. 4, the upper surface 134 of the closing region 130 includes a first tapering region denoted by dashed line 160 that preferably extends from approximately a maximum diameter of the large pour opening portion 146 and encompasses the upper surface 134 along the X axis toward the pour lip region 150 and surrounding the perimeter portions of the narrow and intermediate pour opening portions 142, 144. The first tapering region 160 is sloped from the pour lip and from the maximum diameter region toward the narrow and intermediate pour opening portions. In this manner, any fluid retained on the upper surface within this first tapering region of the cap closing surface when the pouring process is terminated (and the container placed on a horizontal surface), will flow back into the container. Further, a second tapering region 162 may be generally defined by a downwardly sloping surface from an outer perimeter toward a center of the closing surface, i.e., toward the perimeters of the pour opening portions.

The cap assembly 100 further includes a lid 170 dimensioned for receipt over the closing region of the body. The lid is preferably connected to the body by a hinge 172 that is integrally molded to and interconnects the body and lid, the hinge typically having a thinner cross-section or flexible region that facilitates pivoting movement of the lid relative to the body about the hinge. The lid has a generally planar conformation so that when rotated about an axis "Y" of the hinge 172 into overlying or covering relation with the closing region 130, the lid completely covers the upper surface 134.

Figure 1:
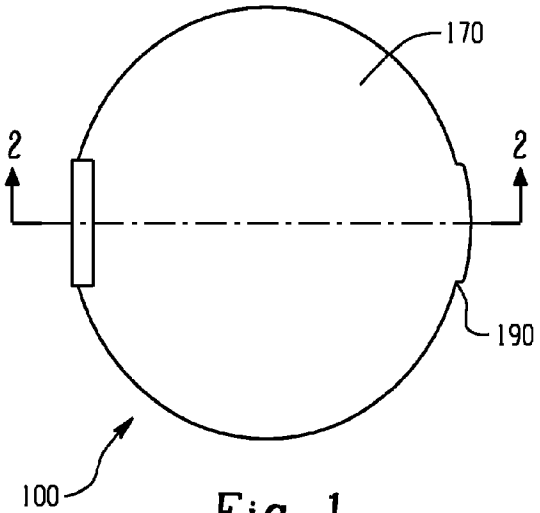
FIG. 1 is a plan view of a first embodiment of a new cap assembly.
Figure 2:
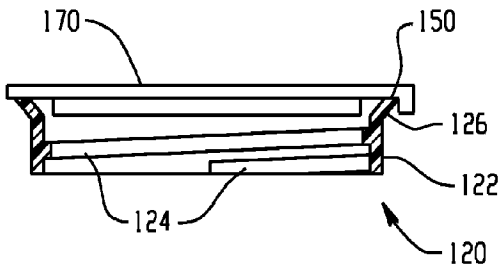
FIG. 2 is a cross sectional view taken generally along the lines 2-2 of FIG. 1.
Figure 3:
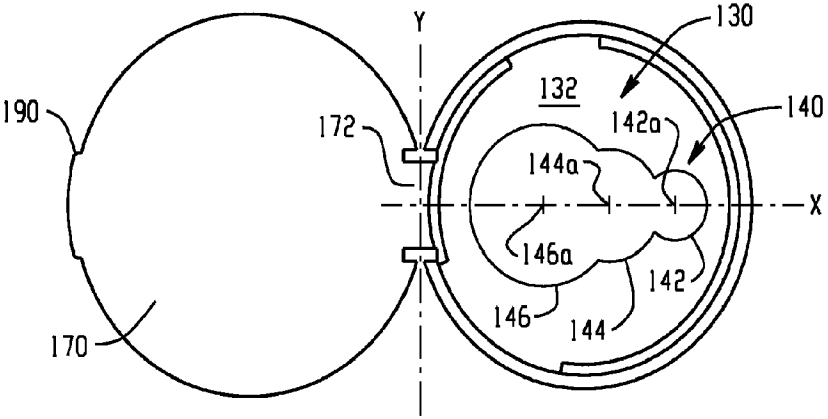
FIG. 3 is a plan view from an underside of the cap with the lid in an open position relative to the body.

Further, and as best illustrated in FIGS. 2 and 4, extending outwardly from a first or interior surface 174 of the lid is a seal 176 having substantially the same conformation as the opening 140 in the closing surface. That is, the seal 176 includes first, second, and third portions 182, 184, 186 having different sized, interconnected arcuate perimeter portions for mating, sealing receipt within the contour of the similarly dimensioned pour opening portions 142, 144, 146 of the opening 140 in the closing region 130 when the lid is closed. Thus, as the lid 170 is pivoted or moved about the hinge axis Y from the open position shown in FIGS. 3 and 4 toward the closed position shown in FIGS. 1, 2, and 5, the seal 176 is progressively received in the cap opening 140. More specifically, the progressive, sealing engagement proceeds from the hinge side toward the pour lip 150. The third seal portion 186 is received in and sealingly engages the closing surface along the third pour opening portion 146, then the second seal portion 184 is received in and sealingly engages the closing surface along the second pour opening portion 144, and lastly the first seal portion 182 is received in and sealingly engages the closing surface along the first pour opening portion 142. This provides a no leak, repeatable seal.

A locking tab 190 extends outwardly from the perimeter of the lid in a region generally diametrically opposite from the hinge 172. The locking tab is conformed to snap fit over the pour lip 150 and provides a tactile, snap connection evidencing that the lid has been received over the closing surface and that the seal 176 has effectively sealed the cap opening 140. Since the cap is assembly is preferably fusion bonded (welded) to the neck 104, whether fluid exits the container opening 108 is controlled by the cap and particularly whether the lid is in sealed engagement with the closing surface. Moreover, the rate at which fluid is poured from the cap opening 140 is closely controlled by the different sized pour opening portions. If a small amount of fluid is to be poured from the container under control, the container is tipped slightly and the fluid will proceed from the first pour opening portion 142 only while the second and third pour opening portions act as the vent to prevent "glugging" during the pour process. If a greater amount of fluid or an increased rate of dispensing fluid is desired, the container is tilted further so that the fluid additionally exits from the second pour opening portion 144 along with the fluid pouring from the first pour opening portion. The third pour opening portion serves as the vent to allow air to enter the container during the increased pour event (i.e., to prevent glugging). If an even greater amount of fluid or further increased rate of dispensing fluid from the container is desired, then a portion of the third pour opening portion 146 adjacent the second pour opening portion will contribute to dispensing fluid while the remainder of the third pour opening portion acts as a vent.

Figure 6:
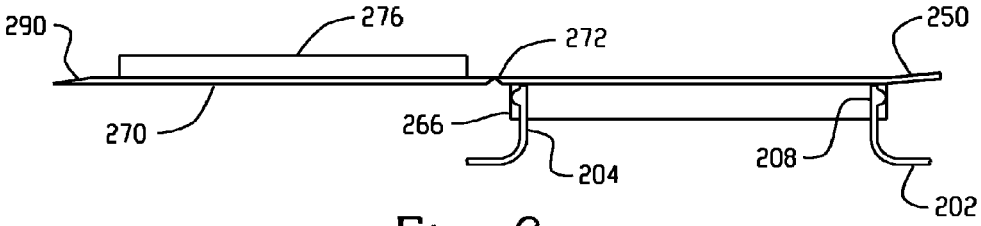
FIG. 6 is an elevational view of the container opening with a second embodiment of a cap shown installed thereon in an open condition.
Figure 7:
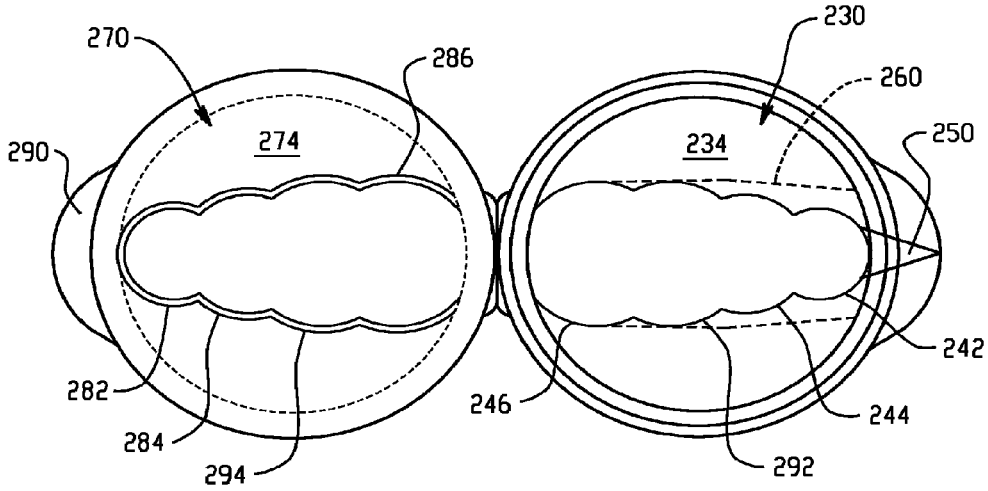
FIG. 7 is a plan view taken from above in FIG. 6.

The embodiment of FIGS. 6 and 7 is substantially identical to that of FIGS. 1-5. The primary distinction is the addition of a fourth pour opening portion to the opening in the cap closing surface, and likewise, a fourth portion to the seal provided in the underside surface of the lid. For purposes of consistency and brevity, like reference numerals increased by a factor of "100" refer to like components, while new components are identified by new reference numerals. For example, cap 100 in the embodiment of FIGS. 1-5 is comparable to cap 200 in the embodiment of FIGS. 5 and 6. Particularly, a fourth pour opening portion 292 of the opening is provided by a slightly larger, intermediate pour opening portion in the closing surface and is preferably interposed between the second and third pour opening portions 244, 246, respectively. Likewise, the seal includes a second, larger intermediate portion 294 interposed between the second and third seal portions 284, 286. As will be appreciated, the fourth seal portion is dimensioned for sealing engagement with the closure surface 230 along the fourth pour opening portion 292. In substantially all other respects, the cap of FIGS. 6 and 7 is substantially identical in function and operability.

As noted above, the overall height of the cap assembly is up to approximately 50% smaller than known flip cap arrangements which results in substantial material savings per container (an approximate savings of about 10% material savings compared to prior art caps). Another attribute of this improved cap is that once the cap is applied or mounted on the container, the cap need never be removed from the container. The cap can be advantageously hermetically sealed to the container (i.e., fusion bonded), if desired, to provide further tamper protection. Thus, the container is filled, the cap applied over the container opening, and the perimeter of the cap is fusion bonded to the container. This arrangement also eliminates the use of a conventional foil/polyethylene composite seal that is commonly used to seal the container opening beneath the cap and that requires the cap to be removed from the container by the consumer to remove the seal, and then the cap re-secured to the container.

The snowman-shape of the cap opening and the corresponding seal on the lid advantageously uses the hoop stress of multiple circular portions instead of one large opening to form this seal. Also, fluid poured through the cap opening can be carefully controlled or metered in progressive fashion starting with low flow through the narrow pour opening portion, and proceeding to add additional flow from the intermediate and large pour opening portions as the bottle is further tipped. In each instance, a large air opening is still provided for effective venting so that fluid does not "glug" as the fluid is poured from the container. A calibrated, controlled pour is provided, and the cap assembly provides for an effective seal to be formed between the lid of the cap and the closing surface as a result of the hoop stress of each arcuate perimeter portion of the opening and seal to form a progressive seal.

FIGS. 8-11 illustrate a third exemplary embodiment of a cap assembly 300, again a preferably molded plastic cap (such as a high density polyethylene). Likewise, and in a manner similar to the above-described embodiments, the cap is shown as a generally annular conformation, such as a body 320 having a sidewall 322 that includes internal thread portions 324 operatively cooperating with associated external thread portions on a container. The thread portions 324 may be circumferentially spaced thread segments or thread lugs, or may be a continuous helical thread, for operative engagement with external threads or thread portions of the container. The cap may be threaded on to the shoulder of a container, or alternatively may be manually pushed over the container threads. Alternatively, no threaded engagement may be used and the cap is simply snap-fit over a flange and subsequently fusion bonded to the container.

As is evident from a comparison of FIGS. 8-11 with FIGS. 1-7, many of the features of the earlier embodiments are included in this embodiment. However, one significant difference relates to the addition of a tear-away panel 396 that is integrally molded with the cap. The panel is segregated about a periphery by a frangible, thin walled portion 398 where the tear-away panel interconnects with the closing surface 334 of the cap. A tab, such as ring tab 400, is secured to the tear-away panel 396, and once a consumer opens the lid 370 of the cap assembly, by rotating the lid about the hinge 372 to an open position (FIG. 8), the tab is exposed and the consumer can remove the tear-away panel 396 by rupturing along the frangible connection 398. Once the tear-away panel is removed, an opening is formed in the cap assembly in much the same manner as shown with regard to the earlier embodiments. Likewise, seal 376 extending from the underside of the lid surface 370 is dimensioned for a sliding fit along interconnecting wall 402 that interconnects the tear-away panel (or opening once the tear-away panel is removed) relative to upper surface 334. Preferably, the seal includes a bead 404 having a slightly greater dimension than the sidewall 406 of the seal so that upon full closure of the lid relative to the body, the bead 404 slides along the interconnecting wall until bead 404 is snap-fit with a corresponding bead or flange 408 adjacent the frangible portion 398. In this manner, the lid provides a snap-fit connection with the body, either with the tear-away panel in place or after the tear-away panel has been removed. The interference fit between the beads 404, 408, and the wall 406 of the seal with the interconnecting wall 402 provides for an original seal, and subsequent re-sealing of the contents of the fluid container. In this manner, tamper-evident protection is provided by way of the tear-away panel, i.e., a consumer can readily recognize if the tear-away panel is missing and that the contents of the container have been possibly compromised.

Use of the tear-away panel which may be easily removed by pulling upwardly on the ring tab 400 and removing the panel 396 from the remainder of the cap assembly, advantageously eliminates the need for a separate foil seal, gasket, or similar structure. Stated another way, once the cap 300 is installed on the container, and preferably fusion bonded thereto, the cap need not be removed to provide access to the container. Instead, the tear-away panel 396 is removed, and the lid and associated seal 376 used to seal and re-seal the opening formed in the cap body.

Figure 8:
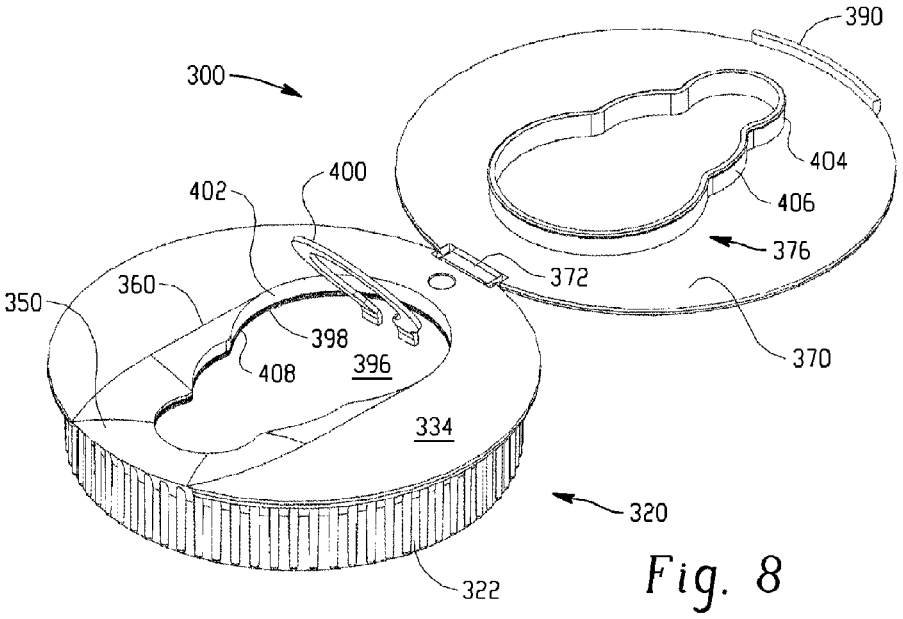
FIGS. 8-11 illustrate different views of a third exemplary embodiment.
Figure 9:
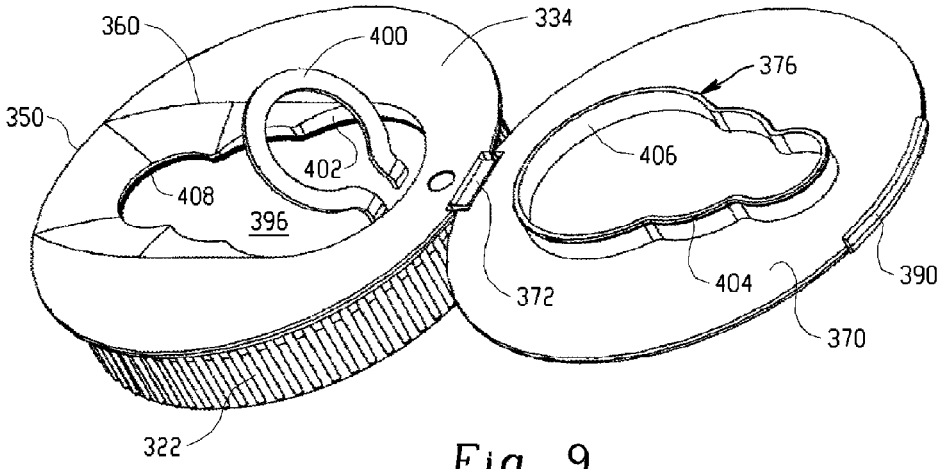
Figure 10:
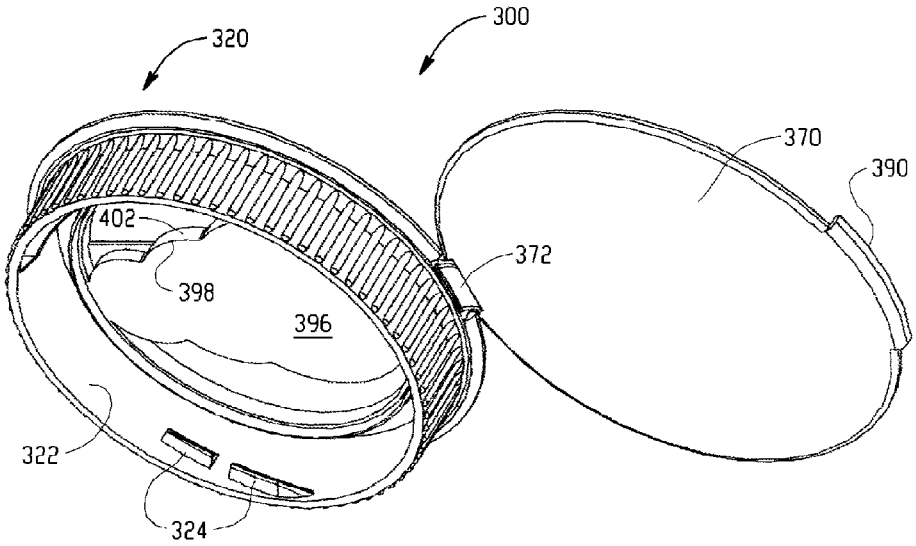
Figure 11:
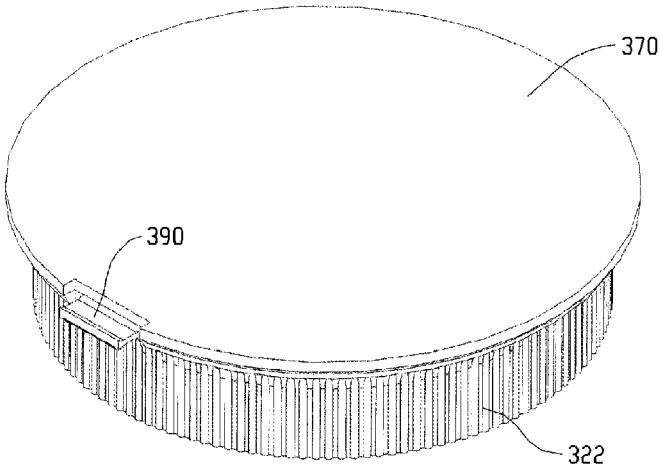

As is also evident in FIGS. 8-10, the interconnecting wall 402 may vary in height about its perimeter. That is, because of the first tapering region 360, and the pour lip 350, the height of the interconnecting wall 402 may be slightly larger adjacent the hinge, and reduced in height as the interconnecting wall proceeds about the perimeter toward the pour lip 350. In any event, the seal 376, and particularly the bead 404 thereof, cooperates with bead 408 of the interconnecting wall to provide an effective seal from the external environment.

The disclosure has been described with reference to the preferred embodiments. Obviously, modifications and alterations will occur to others upon reading and understanding the preceding detailed description. It is intended that the exemplary embodiment be construed as including all such modifications and alterations in so far as they come within the scope of the appended claims or the equivalents thereof.

The invention claimed is:

1. A cap for receipt on an associated bottle opening, the cap comprising:

a sidewall, a closing surface extending substantially perpendicular to the sidewall and dimensioned to cover the associated bottle opening, an opening in the closing surface having first, second, and third portions that progressively increase in size and form interconnected, distinct narrow, intermediate, and large pour opening portions that each include arcuate perimeters; and a lid selectively received on the closing surface and including a seal extending outwardly from a surface thereof, the seal having first, second, and third portions that substantially conform to the first, second, and third portions of the opening.

2. The cap of claim 1 wherein the arcuate perimeter of the opening first and third portions extend over approximately 235° degrees.

3. The cap of claim 1 further comprising a hinge connecting the lid to the sidewall.

4. The cap of claim 3 wherein the narrow pour opening portion is disposed opposite from the hinge.

5. The cap of claim 4 wherein the first, second, and third portions of the opening are disposed in linear relation.

6. The cap of claim 4 wherein the closing surface includes a first tapering region that extends from a maximum diameter of the large pour opening portion and around perimeter portions of the narrow and intermediate pour opening portions.

7. The cap of claim 6 wherein the first tapering region extends from opposite edges of the maximum diameter of the large pour opening portion in a direction substantially perpendicular to a pivot axis of the hinge.

8. The cap of claim 7 further comprising a second tapering region that extends downwardly from an outer perimeter of the closing surface toward a center of the closing surface.

9. The cap of claim 7 further comprising a second tapering region that extends downwardly from an outer perimeter of the closing surface toward the opening.

10. The cap of claim 1 wherein the body is annular and includes a thread member extending around at least a portion of an inner surface thereof.

11. The cap of claim 1 wherein a perimeter portion of an interconnection between the closing surface and body tapers into a pour lip.

12. The cap of claim 1 further comprising an interconnecting wall interposed between the closing surface and the opening, and wherein the seal engages the interconnecting wall adjacent the opening.

13. The cap of claim 12 wherein the interconnecting wall has a varying dimension from about a perimeter of the opening.

14. The cap of claim 13 wherein the closing surface includes a first tapering region that extends from a maximum diameter of the large pour opening portion and around perimeter portions of the narrow and intermediate pour opening portions, and interconnecting wall decreases in height as the wall extends from adjacent the large opening portion toward the narrow pour opening portion.

15. A cap for receipt on an associated container opening, the cap comprising:

a sidewall that extending around at least a portion of an inner surface thereof, a closing surface extending substantially perpendicular to the sidewall and dimensioned to cover the associated bottle opening, a tear-away panel portion in the closing surface that forms an opening having first, second, and third portions having arcuate perimeters that form distinct opening portions that progressively increase in size from narrow, intermediate, and large pour opening portions upon removal from the closing surface; and a lid selectively received on the closing surface and including a seal extending outwardly from a surface and including a seal extending outwardly from a surface thereof, the seal having corresponding first, second, and third portions that progressively increase in size and conform to the narrow, intermediate, and large portions of the opening.

16. The cap of claim 15 wherein the sidewall is annular.

17. The cap of claim 15 wherein the sidewall includes a thread member along an inner surface thereof.

18. The cap of claim 15 further comprising a tab attached to the tear-away panel portion for facilitating removal of the panel portion from the closing surface.

19. The cap of claim 15 wherein the cap is formed from a rigid plastic.

20. The cap of claim 15 wherein the tear-away panel portion and the closing surface are connected by a reduced cross-sectional dimensioned frangible region.

21. The cap of claim 15 wherein the tear-away panel portion is recessed relative to closing surface and spaced therefrom by an interconnecting wall.

22. The cap of claim 21 wherein the lid seal is dimensioned for engagement with the interconnecting wall.

23. The cap of claim 1 wherein the narrow, intermediate, and large pour opening portions extend serially from a pour lip opposite from a hinge connecting the lid to the sidewall of the cap.

* * * * *